US008288949B2

(12) United States Patent
Kostka

(10) Patent No.: US 8,288,949 B2
(45) Date of Patent: Oct. 16, 2012

(54) FLUORESCENT LAMP WITH PROTECTIVE SLEEVE

(75) Inventor: James Michael Kostka, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 272 days.

(21) Appl. No.: 12/432,411

(22) Filed: Apr. 29, 2009

(65) Prior Publication Data

US 2010/0277055 A1 Nov. 4, 2010

(51) Int. Cl.
*H01J 17/16* (2006.01)

(52) U.S. Cl. ..... 313/635; 313/636

(58) Field of Classification Search ..... 313/634–636
See application file for complete search history.

(56) References Cited

U.S. PATENT DOCUMENTS

| | | | | |
|---|---|---|---|---|
| 2,135,696 | A | 11/1938 | Baumhauer | |
| 2,363,109 | A | 11/1944 | Keiffer | |
| 2,791,679 | A | 5/1957 | Hierholzer, Jr. et al. | |
| 3,124,307 | A | 3/1964 | Hoskins et al. | |
| 3,179,792 | A | 4/1965 | Harry | |
| 3,351,409 | A | 11/1967 | McGuire | |
| 3,358,167 | A | 12/1967 | Shanks | |
| 3,453,470 | A | 7/1969 | Hammer | |
| 3,602,759 | A | 8/1971 | Evans | |
| 3,673,401 | A | 6/1972 | Pont | |
| 3,751,653 | A | 8/1973 | Henry | |
| 3,808,495 | A | 4/1974 | Win | |
| 4,048,537 | A | 9/1977 | Blaisdell et al. | |
| 4,924,368 | A | 5/1990 | Northrop | |
| 5,124,618 | A | 6/1992 | Ohtaka et al. | |
| 5,173,637 | A | 12/1992 | Sica | |
| 5,188,451 | A | 2/1993 | Shanks | |
| 5,227,693 | A | 7/1993 | Sakakibara et al. | |
| 5,291,379 | A | 3/1994 | Lu | |
| 5,536,998 | A | 7/1996 | Sica | |
| 5,729,085 | A * | 3/1998 | Sica et al. | 313/493 |
| 6,078,136 | A | 6/2000 | Sica | |
| 6,246,167 | B1 | 6/2001 | Sica | |
| 6,254,318 | B1 | 7/2001 | Sica | |
| 6,406,167 | B1 | 6/2002 | Bock | |
| 6,422,721 | B1 | 7/2002 | Plunk | |
| 6,641,920 | B2 * | 11/2003 | Conn et al. | 428/412 |

(Continued)

FOREIGN PATENT DOCUMENTS

| | | |
|---|---|---|
| EP | 0544407 | 6/1993 |

(Continued)

OTHER PUBLICATIONS

Naitove, Matthew H., "Close-Up on Technology—Materials, New Polymer Uses Sunlight to Arm Itself Against UV Damage", Plastics Technology, www.PTOnline.com/articles/200402cu3.html, Feb. 2004, 4 pages.

(Continued)

*Primary Examiner* — Nimeshkumar Patel
*Assistant Examiner* — Christopher Raabe
(74) *Attorney, Agent, or Firm* — Pearne & Gordon LLP

(57) ABSTRACT

A fluorescent lamp having a protective polymeric sleeve to provide impact resistance and contain fragments if the lamp shatters. The sleeve comprises an inner layer of a UV-blocking polymeric material and an adjacent layer of a polymeric material, preferably polycarbonate. The inner layer is preferably a co-polymer comprised of a polycarbonate block and a block comprised of isophthalic acid, terephthalic acid, and resorcinol. The inner layer helps protect the rest of the sleeve from UV degradation.

24 Claims, 1 Drawing Sheet

U.S. PATENT DOCUMENTS

| | | | | |
|---|---|---|---|---|
| 7,477,005 | B2 | 1/2009 | Hlahol et al. | |
| 7,500,896 | B2 | 3/2009 | Trushell | |
| 8,053,962 | B2 * | 11/2011 | Kostka et al. | 313/112 |
| 2002/0187705 | A1 | 12/2002 | Dupont | |
| 2004/0028907 | A1 * | 2/2004 | Wang | 428/412 |
| 2004/0178394 | A1 | 9/2004 | Tanaka et al. | |
| 2009/0209162 | A1 | 8/2009 | Bartol | |
| 2010/0232830 | A1 | 9/2010 | Wada et al. | |

FOREIGN PATENT DOCUMENTS

| | | |
|---|---|---|
| EP | 1176627 | 1/2002 |
| FR | 2031277 | 11/1970 |
| WO | 2006006097 | 1/2006 |
| WO | 2007108488 A1 | 9/2007 |

OTHER PUBLICATIONS

Office Action from U.S. Appl. No. 12/432,215 dated Mar. 16, 2011.
European Search Report dated Oct. 8, 2010 for Applicant/Proprietor General Electric Company. Search completed on Aug. 4, 2010.
European Search Report for corresponding Application Serial No. EP10160944 completed on Feb. 27, 2012.

* cited by examiner

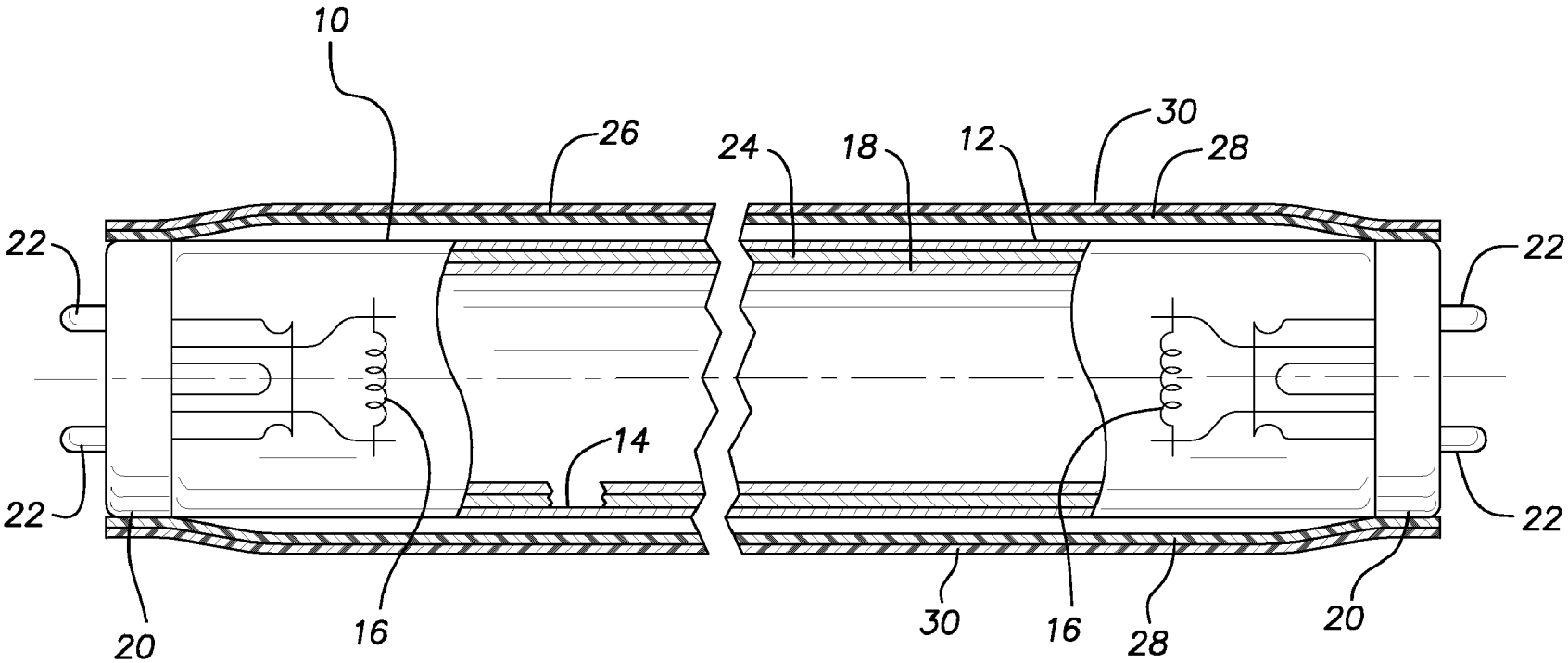
22
22
20
28
30
28
16
12
30
18
24
26
14
10
16
20
22
22

FLUORESCENT LAMP WITH PROTECTIVE SLEEVE

BACKGROUND OF THE INVENTION

1. Field of the Invention

The present invention is directed to a fluorescent lamp with a protective polymeric sleeve having a plurality of layers, the inner layer being UV-blocking polymeric material.

2. Description of Related Art

Fluorescent lamps are susceptible to breaking if dropped or bumped. Coatings and sleeves have been developed for fluorescent lamps which have two functions: 1) to absorb impacts and thus impart increased impact resistance to the lamp, to reduce breakage, and 2) to act as a containment envelope to contain shards or fragments of glass in case the lamp shatters. Often, these coatings and sleeves are subject to degradation from UV-light emitted from the fluorescent lamp. Such degradation causes the coatings and sleeves to develop yellowing or haze that partially blocks transmission of visible light. Moreover, such degradation causes the coatings and sleeves to become more brittle over time, so that they are less able to provide impact resistance and act as containment envelopes. As a result, over time, the fluorescent lamp becomes less protected from breakage and, if it does shatter, the glass fragments are less likely to be contained by an intact containment envelope. Accordingly, there is a need for a protective sleeve that is less susceptible to UV-degradation.

SUMMARY OF THE INVENTION

A sleeve-protected fluorescent lamp comprising a mercury vapor discharge fluorescent lamp surrounded by a sleeve. The fluorescent lamp comprises a light-transmissive glass envelope having an inner surface, a pair of electrode structures mounted inside said envelope, a first base sealing a first end of the lamp, a second base sealing a second end of the lamp, a discharge-sustaining fill comprising inert gas sealed inside said envelope, and a phosphor layer inside said envelope and adjacent the inner surface of the envelope. The sleeve is a polymeric sleeve having an inner layer fixed to an adjacent, preferably an outer, layer. The inner layer is a UV-blocking polymeric material. The adjacent layer is a polymeric material. The inner layer material is different from the adjacent layer material.

BRIEF DESCRIPTION OF THE DRAWINGS

FIG. 1 shows schematically a fluorescent lamp partially in cross section surrounded by a protective sleeve shown in cross section.

DETAILED DESCRIPTION OF THE PREFERRED EMBODIMENTS OF THE INVENTION

In the description that follows, when a preferred range such as 5 to 25 (or 5-25), is given, this means preferably at least 5 and, separately and independently, preferably not more than 25. UV light is generally considered to be 10-400 nm.

With reference to FIG. 1 there is shown a fluorescent lamp 10 surrounded by a sleeve 26 according to the invention. The fluorescent lamp 10 is a conventional mercury vapor discharge fluorescent lamp and includes a light-transmissive glass tube or envelope 12 having an inner surface 14, electrode structures 16 for providing an electric discharge to the interior of the glass envelope 12, a phosphor layer 18 within the interior of the glass envelope 12 and a discharge-sustaining fill comprising, for example, argon, neon, krypton, xenon or mixtures thereof, sealed within the glass envelope along with a small amount of mercury. Between the inner surface 14 of the envelope 12 and the phosphor layer 18 is preferably but not necessarily a barrier layer 24 as known in the art. The barrier layer 24 can be made, for example, of alumina.

The lamp 10 is hermetically sealed by bases 20 attached at both ends of the envelope 12. The electrode structures 16 are connected to pins 22 so that electric energy can be carried through the pins to the electrode structures 16. When the lamp 10 is energized, an electric arc is created between the electrode structures 16, the mercury is energized and emits UV light, and the phosphors in the phosphor layer absorb the UV light and re-emit light in the visible range. The barrier layer 24 permits visible light to pass through and functions to reflect UV light that has passed through the phosphor layer back into the phosphor layer where it can be utilized. Nonetheless, some UV light can escape out of the envelope 12 and strike the protective sleeve 26.

Lamp 10 is preferably linear, such as 2, 3, 4, 6 or 8 feet long and preferably circular in cross section. Lamp 10 can be any diameter as known in the art, preferably ⅝, ¾, 1, 1¼ or 1½ inches in diameter, such as T5 to T12 lamps as known in the art. Lamp 10 is preferably a T8 or T12 lamp as known in the art.

FIG. 1 also shows sleeve 26 according to the invention. Sleeve 26 surrounds envelope 12 and preferably has the same cross-sectional geometry as envelope 12; for example, preferably envelope 12 and sleeve 26 are both circular in cross section.

Sleeve 26 is preferably a bilayer, that is, two layers fixed together, such as the two layers being coextruded to form an integral or unitary sleeve. Sleeve 26 may appear to be a single layer of material but it is actually, for example, two polymeric layers coextruded together.

The inner layer 28 of sleeve 26 is UV-blocking polymeric material, preferably a copolymer comprised of a polycarbonate block and a block comprised of isophthalic acid, terephthalic acid, and resorcinol (ITR), such as LEXAN SLX available from Saudi Basic Industries Corporation (SABIC). As used herein and in the claims, "UV-blocking polymeric material" includes a polymeric material having UV-blocking capability at least as effective as a copolymer comprised of a polycarbonate block and a block comprised of isophthalic acid, terephthalic acid and resorcinol (ITR), such as LEXAN SLX. LEXAN SLX means and includes any of the various grades of LEXAN SLX marketed by SABIC, preferably LEXAN SLX 253IT and LEXAN SLX ML6031.

Upon exposure to UV light, the exterior layer or skin (approximately the outer 3 microns) of the LEXAN SLX copolymer, ie, the portion of the layer closest to the UV-arc in the lamp, undergoes a structural isomerization. This new conformation of the polymer happens to be UV resistant/blocking; this creates an approximately 3 micron thick skin on the inside surface of the sleeve 26 that blocks UV light and protects the rest of the bulk material and the rest of the sleeve 26 from being degraded by the UV light from the fluorescent tube. After structural isomerization, the LEXAN SLX has about 0% transmission at 380 nm and less, and from 380 nm to 400 nm the % transmission increases from about 0% transmission at 380 nm to about 40% transmission at 400 nm in substantially a straight line fashion. Polymeric materials that exhibit at least this level of resistance to UV transmission are also UV-blocking polymeric materials. In addition, polymeric materials that exhibit at least the following levels of resistance to UV transmission after 50 hours of operation are included within the meaning of "UV-blocking polymeric material": not more than 10% transmission at 360 nm, not more than 10% or 20% transmission at 380 nm, not more than 30%, 40% or 45% transmission at 390 nm, and/or not more than 50%, 60% or 70% transmission at 400 nm, when the material is 25-100 microns thick.

The adjacent or outer layer 30 of sleeve 26 is light-transmissive or transparent and is preferably polycarbonate, polyester such as polyethylene terephthalate (PET), polyurethane, fluorinated polymers such as fluorinated ethylene propylene (FEP), or polyacrylate, each of these being preferably UV-stabilized by the addition of one or more UV-stabilizers as known in the art at conventional loading levels. Adjacent or outer layer 30 is preferably UV-stabilized polycarbonate, such as LEXAN 103 or LEXAN RL7245 from SABIC. Less preferably an additional polymeric layer can be added on top of layer 30, for example, layer 30 can be UV-stabilized polycarbonate and a layer of PET can be extruded over layer 30.

Sleeve 26 is preferably about 100-1000, more preferably about 150-800, more preferably about 200-600, more preferably about 300-500, more preferably about 350-450, more preferably about 380-400, more preferably about 400, microns thick. Since the inner layer 28 is generally made of more expensive material than outer layer 30, the thickness of inner layer 28 is preferably minimized; inner layer 28 is preferably at least 25 microns thick and preferably not more than 30, 40, 50, 70, 90, 100, 125, 150, 175 or 200 microns thick. Outer layer 30 is preferably the difference between the inner layer and 400 microns, for example, the outer layer is preferably at least 370, 360, 350, 330, 310, 300, 275, 250, 225 or 200 microns thick. Since only the outer three microns of LEXAN SLX provides UV-blocking, it is not necessary that this material be very thick.

Bilayer sleeve 26 is preferably made by coextruding inner layer 28 and outer layer 30. Preferably inner layer 28 is LEXAN SLX copolymer and outer layer 30 is UV-stabilized polycarbonate. The inner layer functions to block transmission of UV light, which if transmitted, acts to degrade, cause yellowing, cause haze, and cause brittleness, of the rest of the inner layer 28 and of the outer layer 30. When the sleeve 26 is degraded, it is less able to protect the lamp from impact shattering and less able to contain glass fragments from flying off. The invention protects sleeve 26 from degradation, so the lamp is more shatter resistant and, if the lamp does shatter, there is better fragment retention.

After the sleeve 26 is made, it is slid onto and attached to the fluorescent lamp in a conventional manner, that is, adhesive is applied to the two end caps or bases of the lamp, the two ends of the sleeve 26 are heated and heat sealed/adhesive sealed to the adhesive coated end caps. So that the sleeve may be slid onto the particular fluorescent lamp, the inside diameter of the sleeve is made so that there is about a 1-2 mm, more preferably about 1 mm, air gap between the outside surface of the glass envelope 12 and the inside surface of the sleeve 26. The difference between the outside diameter of the envelope and the inside diameter of the sleeve is preferably about 0.5-8, 1-6, 1.5-4 or 2-3, mm.

Further details and benefits of the invention are illustrated in the following Example.

Example 1

A standard drop test was performed to compare the shatter resistance of a F40CW linear fluorescent lamp having a sleeve comprised of a UV-resistant polycarbonate-ITR co-polymer (Lexan SLX) ("Type A") and a F40CW linear fluorescent lamp having a sleeve comprised of a conventional Lexan103 UV-stabilized polycarbonate polymer ("Type B"). Six samples of Type A were compared against six samples of Type B. In both cases, the sleeve had a thickness of 0.015±0.003 inches. All samples were allowed to burn continuously for 15,000 hours. The samples were then dropped from a height of 18 feet onto a flat concrete floor, oriented parallel upon dropping. Each lamp was then evaluated based on the following criteria, all of which must be met for an individual lamp to pass the containment test:

Linear fluorescent lamps pass containment testing if:

a) The containment covering retains both bases, b) The containment covering has no rips or tears greater than 2 inches in length and no successive tears exist that would be longer than 2 inches in length if they were joined together, and, c) No glass has exited the containment covering.

Six out of six samples of Type A passed the drop test whereas all six of Type B failed the drop test.

Although the hereinabove described embodiments of the invention constitute the preferred embodiments, it should be understood that modifications can be made thereto without departing from the scope of the invention as set forth in the appended claims.

What is claimed is:

1. A sleeve-protected fluorescent lamp comprising a mercury vapor discharge fluorescent lamp surrounded by a sleeve, the fluorescent lamp comprising a light-transmissive glass envelope having an inner surface, a pair of electrode structures mounted inside said envelope, a first base sealing a first end of the lamp, a second base sealing a second end of the lamp, a discharge-sustaining fill comprising inert gas sealed inside said envelope, and a phosphor layer inside said envelope and adjacent the inner surface of the envelope, the sleeve being a polymeric sleeve having an inner layer fixed to an adjacent outer layer, and an optional layer that is not between said outer layer and said inner layer, the only layers of the sleeve being said inner layer, said outer layer and said optional layer, said inner layer comprising a UV-blocking polymeric material which is a co-polymer comprised of a polycarbonate block and a block comprised of isophthalic acid, terephthalic acid, and resorcinol, said outer layer and said optional layer each comprising a polymeric material, the inner layer material being different from the outer layer material.

2. The lamp of claim 1, wherein the sleeve is a bilayer sleeve.

3. The lamp of claim 2, wherein the outer layer is a polymeric material selected from the group consisting of polycarbonate, polyester, polyurethane, fluorinated polymers and polyacrylate.

4. The lamp of claim 2, wherein the outer layer is a polymeric material selected from the group consisting of polycarbonate, polyethylene terephthalate and polyurethane.

5. The lamp of claim 2, wherein the outer layer is UV-stabilized polycarbonate.

6. The lamp of claim 2, wherein the inner layer permits not more than 60% transmission at 400 nm after 50 hours of operation.

7. The lamp of claim 2, wherein the inner layer permits not more than 40% transmission at 390 nm after 50 hours of operation.

8. The lamp of claim 2, wherein the inner layer is not more than 40 microns thick.

9. The lamp of claim 2, wherein the sleeve is 300-500 microns thick.

10. The lamp of claim 1, wherein the outer layer is UV-stabilized polycarbonate.

11. The lamp of claim 2, wherein the bilayer sleeve is a coextruded bilayer sleeve.

12. The lamp of claim 2, wherein the difference between the outside diameter of the envelope and the inside diameter of the sleeve is about 0.5-8 mm.

13. The lamp of claim 2, wherein the sleeve is 350-450 microns thick.

14. The lamp of claim 2, wherein the UV-blocking characteristics of the UV-blocking polymeric material are provided by a UV isomerized skin of the inner layer closest to the envelope.

15. The lamp of claim 1, further comprising a barrier layer between the inner surface of the envelope and the phosphor layer.

16. The lamp of claim 2, wherein the inner layer permits not more than 20% transmission at 380 nm after 50 hours of operation.

17. The lamp of claim 2, wherein the inner layer permits not more than 50% transmission at 400 nm after 50 hours of operation.

18. The lamp of claim 2, wherein the inner layer permits not more than 10% transmission at 360 nm after 50 hours of operation.

19. The lamp of claim 2, wherein the outer layer is at least 300 microns thick.

20. A sleeve-protected fluorescent lamp comprising a mercury vapor discharge fluorescent lamp surrounded by a sleeve, the fluorescent lamp comprising a light-transmissive glass envelope having an inner surface, a pair of electrode structures mounted inside said envelope, a first base sealing a first end of the lamp, a second base sealing a second end of the lamp, a discharge-sustaining fill comprising inert gas sealed inside said envelope, and a phosphor layer inside said envelope and adjacent the inner surface of the envelope, the sleeve being a polymeric sleeve having an inner layer fixed to an adjacent outer layer, and an optional layer that is not between said outer layer and said inner layer, the only layers of the sleeve being said inner layer, said outer layer and said optional layer, said inner layer comprising a UV-blocking polymeric material, said outer layer and said optional layer each comprising a polymeric material, the inner layer material being different from the outer layer material, wherein said inner layer has a thickness of up to 200 microns and said outer layer has a thickness of at least 200 microns.

21. The lamp of claim 20 wherein said UV-blocking polymeric material is a co-polymer comprised of a polycarbonate block and a block comprised of isophthalic acid, terephthalic acid, and resorcinol.

22. The lamp of claim 20, wherein said outer layer comprises a polymeric material selected from the group consisting of polycarbonate, polyester, fluorinated polymers, polyacrylate, polyethylene terephthalate and polyurethane.

23. The lamp of claim 20 wherein said inner layer and said outer layer are coextruded.

24. The lamp of claim 21, wherein the UV-blocking characteristics of the UV-blocking polymeric material are provided by a UV isomerized skin of said inner layer closest to the envelope.

* * * * *